US005518143A

United States Patent [19]

Iodice

[11] Patent Number: 5,518,143

[45] Date of Patent: May 21, 1996

[54] CONTAINER CAP AND ASSEMBLY FOR SIPPING LIQUIDS

[75] Inventor: Jerry G. Iodice, Mahopac, N.Y.

[73] Assignee: Ansa Company, Inc., Norwalk, Conn.

[21] Appl. No.: 345,612

[22] Filed: Nov. 28, 1994

[51] Int. Cl.[6] ..... A47G 19/22

[52] U.S. Cl. ..... 220/708; D9/441; D9/451; 215/229; 215/307; 215/329; 215/387; 215/388; 215/391; 220/703; 220/705; 220/709; 220/710; 222/78; 222/530

[58] Field of Search ..... D9/451, 441; 222/530, 222/538, 78; 215/229, 44, 227, 307, 309, 329, 388, 389, 387, 391; 220/703, 705, 708, 709, 90.2, 710, 203.2

[56] References Cited

U.S. PATENT DOCUMENTS

| | | | |
|---|---|---|---|
| 2,744,661 | 2/1953 | Davis | 222/189 |
| 2,770,399 | 12/1953 | Gross | 222/211 |
| 2,789,734 | 4/1957 | Biederman | 222/530 |
| 2,844,267 | 11/1956 | Petriccione | 215/100 |
| 2,957,614 | 10/1960 | Krajcovic | 222/530 |
| 3,485,404 | 12/1969 | Newton | 215/309 |
| 3,840,153 | 10/1974 | Devlin | 215/229 X |
| 3,847,313 | 11/1974 | Micallef | 222/538 X |
| 4,165,814 | 8/1979 | Seel | 215/229 |
| 4,244,477 | 1/1981 | Seel | 215/229 |
| 4,462,544 | 7/1984 | Rutzel et al. | 239/33 |
| 4,596,341 | 6/1986 | Bruffey | 220/705 |
| 4,699,318 | 10/1987 | Donatello et al. | 220/710 X |
| 4,775,060 | 10/1988 | Pinney | 215/391 |
| 4,852,762 | 8/1989 | Chou-Sheng | 215/229 X |
| 5,048,705 | 9/1991 | Lynd et al. | 215/1 A |
| 5,109,995 | 5/1992 | Lou | 220/709 X |
| 5,273,172 | 12/1993 | Rossbach et al. | 222/530 X |

*Primary Examiner*—Allan N. Shoap
*Assistant Examiner*—Robin A. Hylton
*Attorney, Agent, or Firm*—Wood, Herron & Evans

[57] ABSTRACT

A novel cap is designed to facilitate the use of a flexible tube to consume fluids and provide a liquid-tight seal when the cap is firmly secured to the container. Further, the cap is designed to form a smooth or regular inner core for decorative shaped animal head structures thereby alleviating the inherent cleaning difficulties which arise from irregular or asymmetrical caps.

12 Claims, 1 Drawing Sheet

CONTAINER CAP AND ASSEMBLY FOR SIPPING LIQUIDS

BACKGROUND OF THE INVENTION

1. Field of the Invention

The present invention relates generally to caps for bottles or containers, and more particularly to a novel cap which is designed to facilitate the use of a flexible tube to consume fluids and provide a liquid-tight seal when the cap is firmly secured to the container. Further, the cap is designed to form a smooth or regular inner core for decorative shaped animal head structures thereby alleviating the inherent cleaning difficulties which arise from irregular or asymmetrical caps.

2. Description of the Prior Art

U.S. Pat. No. 2,744,661 issued to Davis discloses a container having a removable spout assembly and filter. The removable spout assembly has a means for storing the spout. However, the container assembly is only operative when squeezed due to the flexibility of the container. U.S. Pat. No. 2,770,399 issued to Gross also discloses a flexible fluid dispenser. Although this dispenser is useful with all fluids, it is especially suited for controlled dispensing of viscous or oily fluids. U.S. Pat. No. 2,844,267 issued to Petriccione discloses a closure cap for bottles combined with a sipping straw so that on removal of a portion of the cap a straw will immediately be available. U.S. Pat. Nos. 4,165,814 and 4,244,477 issued to Seel disclose containers for potable liquid which have two holes in the top for securing a drinking straw in a manner such that the loop formed can serve as a handle. Further, one of the holes acts as a vent for the container while the sipping end of the straw is being utilized. Finally, U.S. Pat. No. 4,462,544 issued to Rutzel et al. and U.S. Pat. No. 5,048,705 issued to Lynd et al. both describe devices for dispensing and drinking liquids. U.S. Pat. No. 4,462,544 discloses a device with many flexible tubes for use by a plurality of drinkers and U.S. Pat. No. 5,048,705 discloses a device which discharges liquid upon the application of moderate hand pressure.

None of the aforementioned patents disclose or suggest the advantages of the present invention. Clearly, a need exists for a container cap which provides for the use and storage of a flexible drinking tube and minimizes the possibility of leakage. A further need exists for a cap which eliminates cleaning difficulties associated with irregularly shaped decorative caps.

SUMMARY OF THE INVENTION

In accordance with this invention, a frustoconical molded unitary container cap for use in consuming liquids is provided. The cap has a top wall and a downwardly depending circumferential tubular side wall having a rim for securement to a container top, said side wall having a hole therethrough for receiving a flexible tube for sipping liquid from the container. Above the hole, the cap has a cavity formed in the circumferential wall for storing the drinking end of the tube extending from the hole. The cavity has an air vent aperture to facilitate sipping liquid from the container when the drinking end of the tube is removed from the cavity.

In a preferred embodiment of the invention, the cap rim is threaded for fastening to the container. Further, the hole through the side wall of the cap has an outwardly extending circumferential flange angled upwardly to guide the flexible tube. The cavity above the hole has an outwardly extending circumferential flange angled downwardly for storing the drinking end of the flexible tube. The angulated extending flanges of the hole and cavity provide for the effective use of the flexible tube without kinking.

In another embodiment of the invention, a cap and container assembly for consuming liquids is provided. The assembly comprises a frustoconical molded plastic unitary threaded cap for fastening to a container as above described to a plastic bottle. The cap has a top wall and a downwardly depending circumferential tubular side wall having a rim that is threaded and has a hole therethrough for receiving an elongated flexible plastic drinking tube through which a person may sip liquid from the container. The cap hole has an outwardly extending circumferential flange angled upward to guide the flexible tube. The circumferential wall also has a cavity formed above the hole for storing the drinking end of the tube extending from the hole. Specifically, the cavity has an outwardly extending circumferential flange angled downwardly for receiving and storing the drinking end of the flexible tube and an air vent aperture to facilitate sipping liquid from the container when the drinking end of the tube is removed from the cavity. As a further advantage, the flexible drinking tube has an interference fit with the cavity in the wall to block the venting aperture and prohibit outflow of liquid from the container. The location of the cavity and vent aperture above the hole facilitates the air venting in use and effective storage of the tube when not in use.

Moreover, in another embodiment, the cap serves as the inner smooth or regular core for an irregular or asymmetrical decorative shaped animal head cover. The decorative head cover may take on any form such as animal heads that are expecially attractive to babies or children. A smooth or regular inside surface for the cap core is easily cleaned. Further, decorative head covers for the cap may be interchanged.

The foregoing advantages of the present invention as well as others will be made more fully apparent upon consideration of the invention in light of the following drawings and detailed description in which:

DETAILED DESCRIPTION OF THE PREFERRED EMBODIMENT

Figure 1:
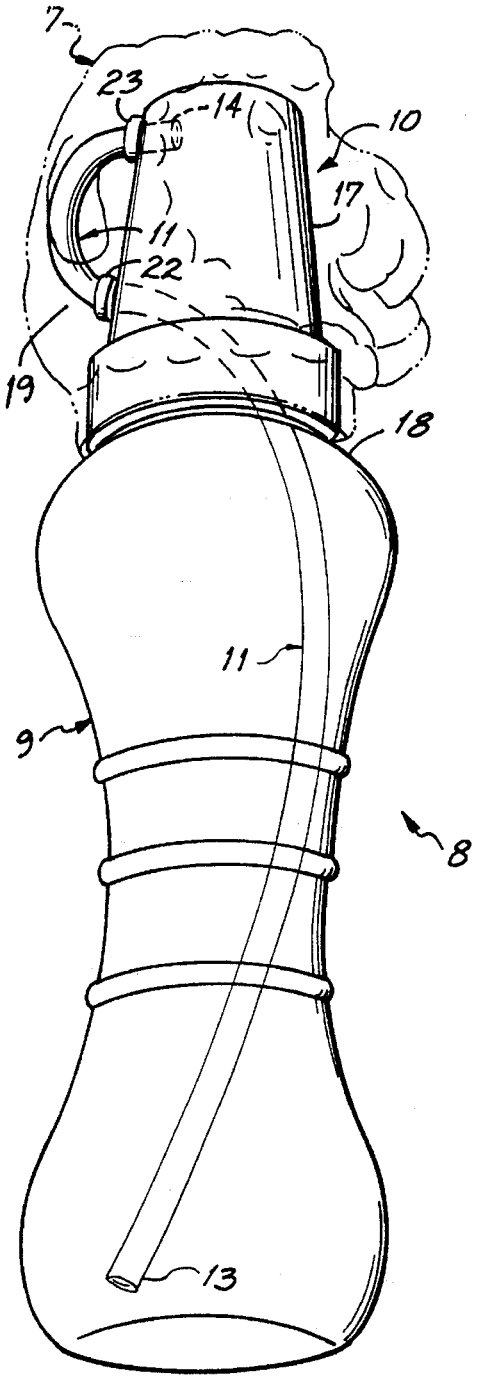
FIG. 1 is an elevational view in perspective of the preferred embodiment showing an elongated drinking tube and a container fastened to a cap having a decorative head cover in phantom with the drinking end of the elongated drinking tube stored in the cavity of the cap.

Referring to FIG. 1, the cap and container assembly of this invention is generally indicated at 8. The container 9 has a cylindrical shape but may take on a variety of shapes depending on the particular use. A frustoconical molded plastic unitary cap 10 having a decorative head cover 7 shown in phantom is secured to container 9. Cap 10 has a top wall and a downwardly depending circumferential tubular side wall 17 which secures an elongated flexible drinking tube 11 extending through hole 15 into the container 9 and into the liquid contained therein so that it may be sipped. The flexible tube 11 is of sufficient length such that a first end 13 may extend into the bottom of the container with a second end extending a sufficient length beyond hole 15 to promote easy drinking and storage in cavity 16. The tube 11 is made of transparent, flexible plastic which facilitates thorough cleaning. Further, the flexibility of plastic allows for the drinking end to be stored without difficulty in cavity 16.

Figure 2:
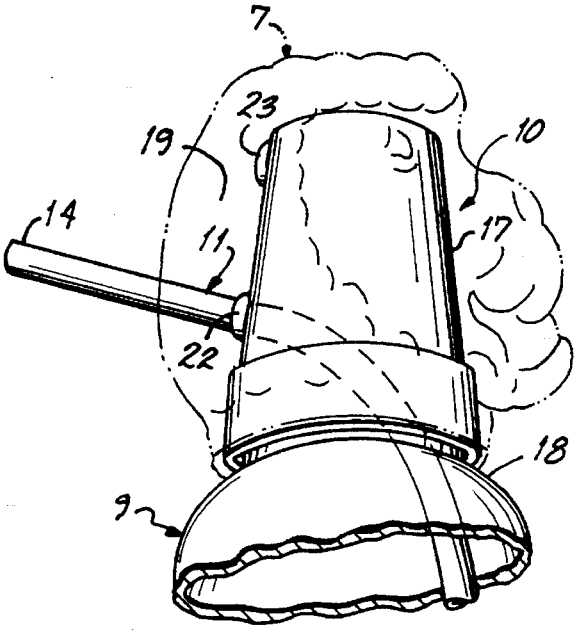
FIG. 2 is a view partly in section of the preferred embodiment of FIG. 1 showing the elongated drinking tube disengaged from the cavity in preparation for drinking, and a decorative head cover in phantom.
Figure 3:
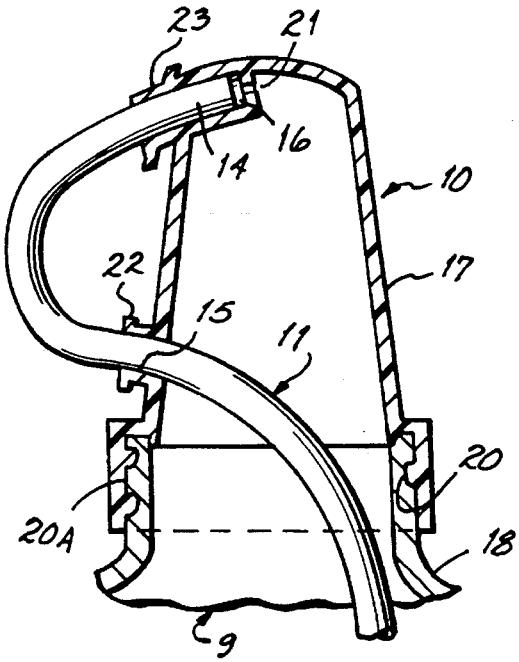
FIG. 3 is a cross-sectional view of the preferred embodiment of FIG. 1 showing the hole of the cap receiving the elongated drinking tube therethrough and the drinking end of the tube stored in the cavity having an air vent aperture.

As further shown in FIGS. 2–3, the frustoconical cap 10 having a circumferential wall 17 is secured to container 9 at its top portion shown generally at 18. The cap 10 can be made of any suitable material but the preferred material is plastic and is threaded at 20. The frustoconical design is advantageous because it provides the inner core for a decorative shaped animal head. The animal head cover 7 has an opening shown generally at 19 which cooperates with the cap hole 15 and cavity 16. Further, the generally smooth or regular interior surface of the core is easily cleaned. Thus, cleaning the crevices of the asymmetrical head is eliminated. Further shown in FIG. 3, the flexible tube 11 is received and secured through hole 15. Tube 11, is positioned so that drinking through its second end 14 is easily accessible.

Referring more particularly to FIG. 3, a cross-sectional view of the molded plastic unitary frustoconical cap 10 having a circumferential wall 17 is shown secured to the top portion 18 of a plastic container 9. Cap 10 has a threaded female portion 20 which is engaged by the threaded male portion 20A of container 9. The flexible elongated drinking tube 11 is received through hole 15 of cap 10. End 14 is simply slid into cavity 16 having a diameter sized to provide an interference fit. Cavity 16 has an air venting aperture 21 which facilitates the use of drinking tube 11 by allowing air to flow into container 9 during sipping of the liquid. Also, flexible drinking tube 11 engages cavity 16 and blocks venting aperture 21 prohibiting outflow of liquid from container 9 creating a liquid seal in the assembly when not in use. Hole 15 has an outwardly extending circumferential flange 22 angled upwardly to guide flexible tube 11. Cavity 16 which lies above hole 15 also has an outwardly extending circumferential flange 23 which is angled downwardly for storing drinking end 14 of flexible tube 11. Outwardly extending flanges 22 and 23 of hole 15 and cavity 16 are advantageous for the reasons developed above.

In operation, container 9 is provided with a quantity of liquid for sipping. Flexible tube 11 extends through hole 15 a distance sufficient to reach the bottom of container 9 where the liquid resides. When drinking end 14 is not stored or engaged with cavity 16 thus blocking air vent aperture 21 and access to the drinking end, it can be used for sipping because there is no vacuum inhibiting the withdrawal of the liquid.

While the principles and advantages of this invention have been described above in connection with a specific and preferred embodiment, it is to be clearly understood that this description is made only by way of example and not as a limitation on the scope of the invention. Thus, having described my invention, many modifications thereto will become apparent to those skilled in the art to which it pertains without deviation from the spirit of the present invention as defined by the scope of the following claims.

What is claimed is:

1. A molded, unitary, frustoconical container cap for use in sipping liquids, said cap having a top wall and a tubular side wall depending downwardly therefrom, said tubular side wall having a rim for securement to a container top, said tubular side wall having a hole therethrough for receiving a flexible tube for sipping liquid from the container, said cap having an outwardly opening cavity formed in said tubular side wall above said hole for storing a drinking end of said tube extending from said hole, said cavity having an air vent aperture to facilitate sipping liquid from the container when the drinking end of the tube is removed from said cavity.

2. The cap of claim 1 having a threaded rim for fastening to said container.

3. The cap of claim 1 wherein said hole has an outwardly extending circumferential flange angled upwardly to guide said flexible tube, and said cavity above said hole has an outwardly extending circumferential flange angled downwardly for storing the drinking end of said flexible tube.

4. A molded, plastic, unitary, threaded, frustoconical container cap for sipping liquids, said cap having a top wall and a tubular side wall depending downwardly therefrom, said tubular side wall having a rim for securement to a container top, said tubular side wall having a hole therethrough for receiving a flexible tube for sipping liquid from said container, said hole having an outwardly extending circumferential flange angled upwardly to guide said flexible tube, said cap having an outwardly opening cavity formed in said tubular side wall above said hole for storing a drinking end of said tube extending from said hole, said cavity having an outwardly extending circumferential flange angled downwardly for storing the drinking end of said flexible tube and an air vent aperture to facilitate sipping liquid from the container when the drinking end of said tube is removed from said cavity.

5. The cap of claim 1 in combination with an asymmetrical decorative cover, said cap having a generally smooth interior surface to facilitate cleaning.

6. The cap of claim 5 wherein said decorative cover is a shaped animal head.

7. The cap of claim 6 wherein said cover has an opening which cooperates with said cap hole and cavity.

8. A cap and container assembly for consuming liquids comprising:

a molded, plastic, unitary, threaded, frustoconical cap for fastening to a container, said cap having a top wall and a tubular side wall depending downwardly therefrom, said tubular side wall having a rim for securement to a container top, said wall having a hole therethrough for receiving a flexible tube for sipping liquid from the container, said hole having an outwardly extending circumferential flange angled upwardly to guide said flexible tube, said cap having an outwardly opening cavity formed in said tubular side wall above said hole for storing a drinking end of said tube extending from said hole, said cavity having an outwardly extending circumferential flange angled downwardly for storing the drinking end of said flexible tube and an air vent aperture to facilitate sipping liquid from said container when the drinking end of said tube is removed from said cavity; and a container for liquid that may be dispensed therefrom, said container having a threaded top for fastening said molded cap.

9. The assembly of claim 8 in combination with an elongated flexible drinking tube for use with said cap and container.

10. The assembly of claim 8 in combination with an asymmetrical decorative cover for said cap, said cap having a generally smooth interior to facilitate cleaning.

11. The assembly of claim 10 wherein said asymmetrical decorative cover is an animal shaped head.

12. The cap of claim 8 wherein said cover has an opening which cooperates with said cap hole and cavity.

* * * * *

UNITED STATES PATENT AND TRADEMARK OFFICE

CERTIFICATE OF CORRECTION

PATENT NO. : 5,518,143

DATED : May 21, 1996

INVENTOR(S) : Jerry G. Iodice

It is certified that error appears in the above-indentified patent and that said Letters Patent is hereby corrected as shown below:

| | |
|---|---|
| Claim 8, column 4, line 40, "said wall having a hole therethrough" | Should be --said tubular side wall having a hole therethrough-- |

Signed and Sealed this

First Day of October, 1996

*Attest:*

*Attesting Officer*

BRUCE LEHMAN

*Commissioner of Patents and Trademarks*